US005752534A

United States Patent [19]

Becher

[11] Patent Number: 5,752,534

[45] Date of Patent: May 19, 1998

[54] UMBRELLA, PARTICULARLY STANDING UMBRELLA

[75] Inventor: Karl Klaus Becher, Gummersbach, Germany

[73] Assignee: Becher Textil-und Stahlbau GmbH, Germany

[21] Appl. No.: 669,426

[22] PCT Filed: Nov. 7, 1995

[86] PCT No.: PCT/DE95/01537

§ 371 Date: Jul. 8, 1996

§ 102(e) Date: Jul. 8, 1996

[87] PCT Pub. No.: WO96/14773

PCT Pub. Date: May 23, 1996

[30] Foreign Application Priority Data

Nov. 9, 1994 [DE] Germany ..... 44 39 725.9
May 24, 1995 [DE] Germany ..... 195 19 034.3

[51] Int. Cl.[6] ..... A45B 25/02

[52] U.S. Cl. ..... 135/15.1; 135/22; 135/23; 135/29; 135/31

[58] Field of Search ..... 135/22, 23, 29, 135/31, 15.1

[56] References Cited

U.S. PATENT DOCUMENTS 973,207 10/1910 Pokorny ..... 135/31
2,775,977 1/1957 Haupt ..... 135/31
4,424,824 1/1984 Becher .
5,329,953 7/1994 Becher ..... 135/31
5,370,144 12/1994 Yang ..... 135/31 X

FOREIGN PATENT DOCUMENTS 4004189 2/1990 Germany .

*Primary Examiner*—Christopher Todd Kent
*Attorney, Agent, or Firm*—Diller, Ramik & Wight

[57] ABSTRACT

In an umbrella, particularly a standing umbrella, sunshade, garden umbrella or similar, with a frame, a roof structure and a canopy, where the roof rods (5) are linked to a pole element (2) bearing a cap (3) and moveable in a telescopic manner relative to the vertical pipe (1), and a slide (4), on which stretchers (6) linked to the roof rods (5) act flexibly, is moveable along the vertical pipe (1), the cap (3) and the slide (4) moving in opposite directions during opening and closing of the umbrella, and with at least one additional stretcher (8) arranged flexibly above the slide (4) between the umbrella pipe (1) and a roof rod (5), the slide (4) being fitted with a locking device (12) with which it can be locked in its upper position and the canopy can be tensioned, it is envisaged that the locking device (12) works in conjunction with a retaining device (13) located on the cap (3) or the moveable pole element (2) to enable simple manual opening of the umbrella and stretching of the canopy, particularly for umbrellas with large diameters.

18 Claims, 6 Drawing Sheets

FIG. 7
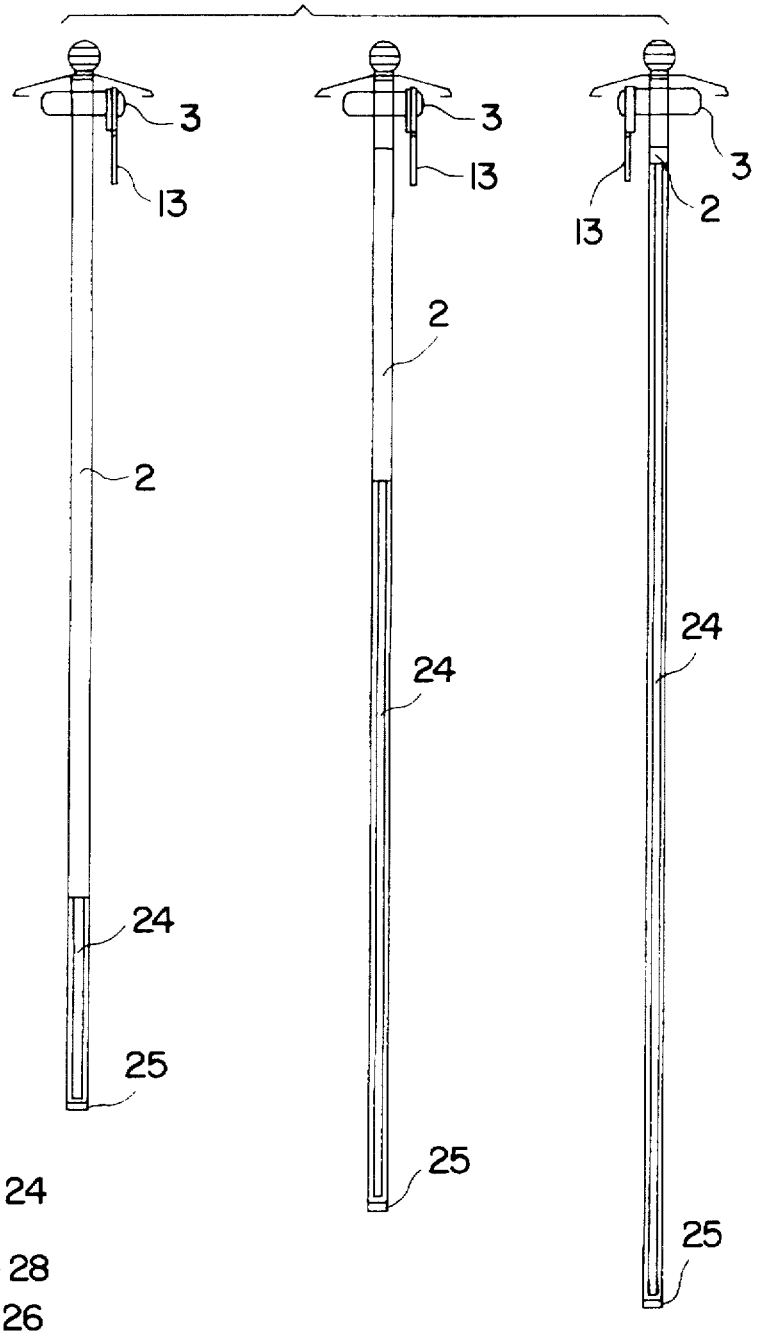
FIG. 9
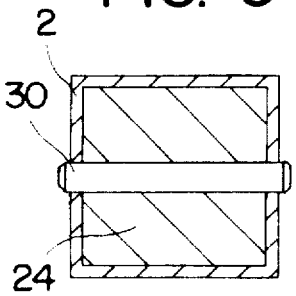
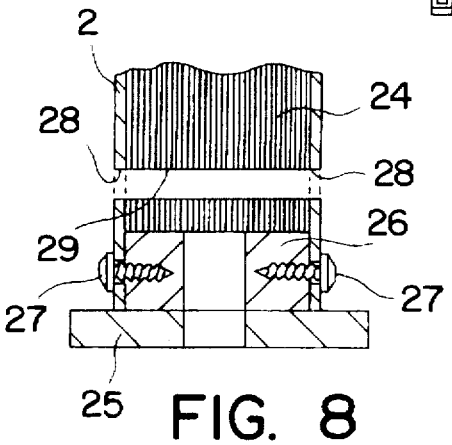
FIG. 8

UMBRELLA, PARTICULARLY STANDING UMBRELLA

The invention relates to an umbrella, particularly a standing umbrella, sunshade, garden umbrella or similar, with a frame, a roof structure and a canopy, where the roof rods are linked to a pole element bearing a cap and moveable in a telescopic manner relative to the vertical pipe, and a slide, on which stretchers linked to the roof rods act flexibly, is moveable along the vertical pipe, the cap and the slide moving in opposite directions during opening and closing of the umbrella, and with at least one additional stretcher arranged flexibly above the slide between the umbrella pipe and a roof rod, the slide being fitted with a locking device with which it can be locked in its upper position and the canopy can be tensioned.

An umbrella of this kind is known from DE-A-41 06 147. The umbrella described in this publication is designed in such a way that the canopy can be easily opened and stretched to achieve sufficient wind resistance without a drive unit, even by a weak person, by manual operation of the slide and the locking device. Particular emphasis is placed on wind resistance in this context, as the umbrella affords protection in all kinds of weather and having to close it if the wind suddenly rises is frequently undesirable or not immediately possible. If the canopy, i.e. the roof membrane, is insufficiently stretched, turbulence occurs on the upper and lower sides of the umbrella membrane in the event of sudden gusts of wind. A fluttering movement thus arises which exerts unpredictable and uncontrollable forces on the umbrella rods. Owing to these forces, the positions of the umbrella rod pivot points in relation to one another can change, in particular, meaning that the canopy as a whole becomes unstable. A precisely defined and temporally constant tension of the canopy is required in order to avoid damage to, or even destruction of, the canopy in strong winds or storms.

A locking device which works in conjunction with a retaining arm fixed to the umbrella pipe is proposed for this purpose in the aforementioned DE-A-41 06 147. The umbrella can then be opened by a person in such a way that he initially pulls the outer edge of the roof towards himself, thus partly opening the umbrella. As the cap and the slide move in opposite directions and the centre of gravity of the roof structure thus remains at virtually the same height, the roof structure comes to a halt when the application of manual force is interrupted or concluded. Thus, when the roof is drawn apart sufficiently, its edge can be released and the slide which moves along the vertical pipe can be grasped. The pushing up of the slide, which can be carried out just as simply, then leads to extensive opening of the umbrella, during which the expenditure of energy necessary to stretch the roof membrane, which can no longer be effected by manually pushing the slide up further, finally becomes apparent. In this extensively open position, the roof structure still comes to a halt if the slide is released, meaning that the locking device, with which the slide can be locked in its upper position and the roof membrane can be tensioned, can now be operated manually. For this purpose, the locking device is preferably fitted with a tension lever lock which works in conjunction with an abutment fitted at the lower end of the retaining arm. By applying the very little force required, the slide can be pushed up along the vertical pipe so far that the tension spring clip of the tension lever lock can be latched into the abutment and tensioned by moving the hand lever.

With the aid of the locking device construction known from DE-A-41 06 147, simple manual stretching of the roof membrane can be effected to create sufficient wind resistance in standing umbrellas with an umbrella diameter of up to about 4 m. In this context, one disadvantage discovered with these umbrellas, which will be described below, does not have such a pronounced effect that the wind stability aspired to with the known construction is impaired.

It has been determined that the clearance in the joints and bearings of the roof structure in the umbrella known from DE-A-41 06 147 contribute to a residual degree of wind instability. Furthermore, a residual extensibility of the membrane remaining after stretching of the roof membrane results in slackening of the tension over the course of time. The larger the umbrella diameter, the greater this residual extensibility. If the fact is taken into consideration that the area of an umbrella of 5 m diameter is already more than 50% larger than that of an umbrella of 4 m diameter, it can be seen that the amount of give in the membrane, which counteracts the goal of wind stability in large standing umbrellas, rapidly increases to considerable proportions owing to its residual extensibility.

Furthermore, in umbrellas with a large roof diameter, the centre of gravity of the entire structure is relatively high in relation to the floor level, which also affects the stability and steadiness of the umbrella. If the umbrella is subjected to a burden of snow, the centre of gravity shifts even higher, meaning that the question of sufficient tilt resistance and column buckling resistance is particularly critical in the event of strong winds.

BACKGROUND OF THE INVENTION

The invention is thus based on the task of further developing an umbrella of the kind mentioned at the start, in order to improve its wind stability and steadiness. According to the invention, this problem is solved by the locking device working in conjunction with a retaining device located on the cap or the moveable pole element in an umbrella of the kind mentioned.

With the development of the locking device according to the invention, not only is the slide locked in its upper position and the canopy thus stretched, but the cap is also fixed in its vertical position. Surprisingly, it has become apparent that this measure avoids the impairment of the aspired high stability of the umbrella which occurs in large umbrellas, in particular.

It has been determined that the aforementioned negative effect is to a large extent caused by the fact that the cap has a tendency to drift upwards during stretching of the umbrella owing to the reactive force of the opposite movement of the cap and the slide. This does indeed occur to a certain extent in the known umbrella, and is contributed to by the clearance in the joints and bearings of the roof structure and the amount of give in the numerous braces of the plane load-bearing structure, i.e. primarily in the roof membrane. Drifting of the cap by about 3 cm has been measured in an umbrella designed according to DE-A-41 06 147 with a diameter of 5 m. Even such a low figure is no longer acceptable in view of the high stability demands on such an umbrella. Owing to the design in accordance with the invention, drifting of the cap after stretching of the umbrella is completely prevented and the disadvantages determined with the known umbrella are thus avoided, particularly for umbrellas with large diameters.

The umbrella according to the invention displays all the advantages described for the umbrella known from DE-A-41 06 147. Reference is made to this publication in order to avoid repetitions.

The retaining device can be fitted with a retaining arm, fixed to the cap or the moveable pole element, with which the locking device interacts.

The locking device can consist of a tension lever lock in the familiar fashion and be fitted with an abutment located on the retaining device and a tension element which interlocks with the abutment.

Furthermore, to facilitate handling during the process of opening and closing the umbrella, the slide is preferably fitted with an extension, designed in the form of a tube pointing away from the canopy, to which the tension element of the tension lever lock is attached. The slide can thus be preferably grasped at the bottom when opening the umbrella and the slide can be locked in its upper position at around the chest height of the operator.

The slide is expediently provided with a drilled hole, an open slot or similar, through which the retaining arm is passed.

The length of the retaining arm is preferably finely adjustable to allow precise setting of the end position of the slide and stretching of the canopy.

In the case of large standing umbrellas with diameters upwards of 4 m, the expenditure of energy necessary to stretch the roof membrane with the help of the locking device is so high that, for example, the locking device can no longer be operated manually without disproportionately lengthening the tension lever. Surprisingly, however, it has proved possible to manually open the umbrella with ease and without auxiliary drive units, even umbrellas with a diameter of over 5 m, if, in addition to the construction according to the invention, it is fitted with a second locking device of the kind known from DE-A-41 06 147, which works in conjunction with a second retaining device located on the vertical pipe. The opening of the canopy then involves two stages: for example, the second locking device is initially used to bring the slide into a position in which manual pretensioning of the canopy can be achieved without difficulty and the slide can be locked with the second locking device. The locking device according to the invention is subsequently operated, exerting a force on the cap which is directed towards the slide, the cap ultimately being locked when a precisely defined and temporally largely constant roof tension is achieved. It has been determined that this force can also be exerted without difficulty, even by a weak person. The advantages of simple manual opening and stretching of the canopy with a high degree of stability, even in strong winds, can be realised in this manner, even for large standing umbrellas.

Conversely, to close the umbrella, the locking device according to the invention is initially slackened and unlocked, whereupon the second locking device can then be slackened and unlocked. The advantages described are particularly striking when the fact is taken into account that, according to a study, the static tension potential of an open umbrella with a diameter of 5 m is just under 300 kp.

As described in DE-A-41 06 147, the second locking device can also be a tension lever lock which displays a fixed abutment and a tension element which interlocks with the abutment. The tension element can be attached to the tubular slide at a point opposite the tension element of the locking device according to the invention.

The wind stability and steadiness of the open umbrella can be further improved by lengthening the lower end of the moveable pole element in comparison with conventional umbrellas of the kind mentioned at the start, the result being that the centre of gravity of the overall umbrella is thus considerably lower in relation to the floor level. Owing to this measure, the tilt resistance and column buckling resistance of the umbrella are markedly improved, particularly in strong winds and under heavy snow burdens.

It has been determined that the weight increase associated with the lengthening of the pole element can be used to counterbalance the friction and the weight ratios of the moveable components of the umbrella, meaning that the slide comes to a halt or moves only slowly if released while opening the umbrella, and the umbrella, as previously mentioned with reference to DE-A-41 06 147, can thus initially be partly opened with ease by pulling the outer edge of the roof outwards, and the slide can then easily be grasped and pushed up along the vertical pipe. In this context, the force needed to move the slide should not exceed 15 kp, preferably 8 kp for large umbrellas with a diameter upwards of 6 m and correspondingly less for smaller umbrellas. To date, this counterbalance was provided by selecting the length of the stretchers and the position of the stretcher linkage points on the roof rods in such a way that the centre of gravity of the roof structure remains at least at roughly the same height when the slide is moved. In a product range with several different umbrella sizes, components of suitable dimensions had to be used for every umbrella size. Apart from improving the general steadiness and wind stability, the aforementioned further development of the invention also facilitates counterbalancing of the weights whilst to a large extent retaining the same components for umbrellas of different sizes.

In most cases, the aforementioned measure has to be combined with the additional fitting of a suitably proportioned counterweight in the lower region of the moveable pole element in order to achieve optimum counterbalancing of the friction and the weights of the moveable components. By combining the lengthening of the moveable pole element by a precisely calculated length and the attachment of a precisely proportioned counterweight, it is possible to counterbalance a product range encompassing all standard sizes with a minimum number of components of different dimensions in such a way that the slide at least virtually comes to a halt if released while opening the umbrella. The counterweight causes a further drop in the centre of gravity of the overall umbrella and thus contributes to wind stability and general steadiness.

In a preferred configuration, the counterweight can be pushed into the lower, open end of the moveable pole element and locked in this inserted position.

Two practical examples of the invention are described in more detail below on the basis of the drawings. The drawings show the following:

BRIEF DESCRIPTION OF THE DRAWINGS

FIG. 7 Three different lengths of the moveable pole element with counterweights fitted therein.

FIG. 8 A longitudinal section through the lower end of the moveable pole element, and FIG. 9 A cross-section along line IX—IX with inserted dowel pin.

DESCRIPTION OF THE PREFERRED EMBODIMENTS

Figure 1:
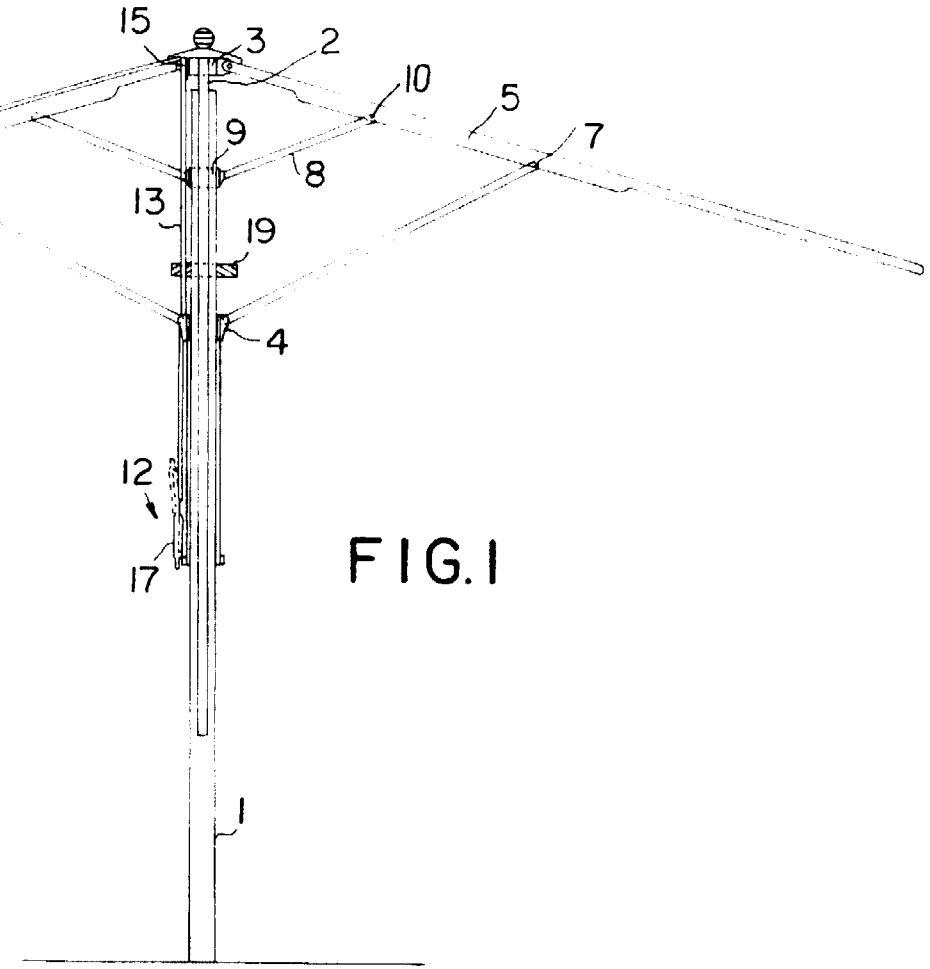
FIG. 1 An umbrella in open position.
Figure 3:
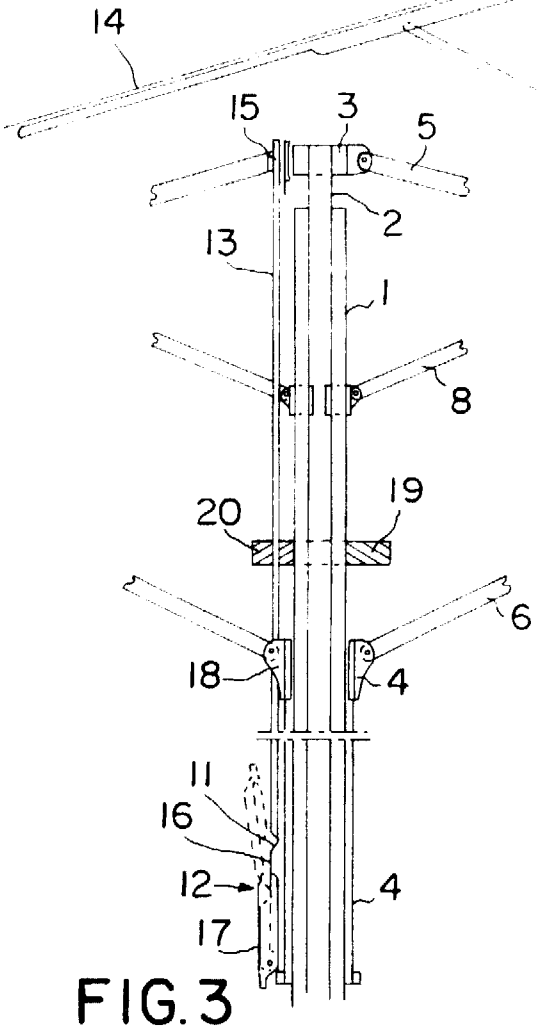
FIG. 3 A large-scale, schematic view of details of the umbrella pipe with locking device.
Figure 2:
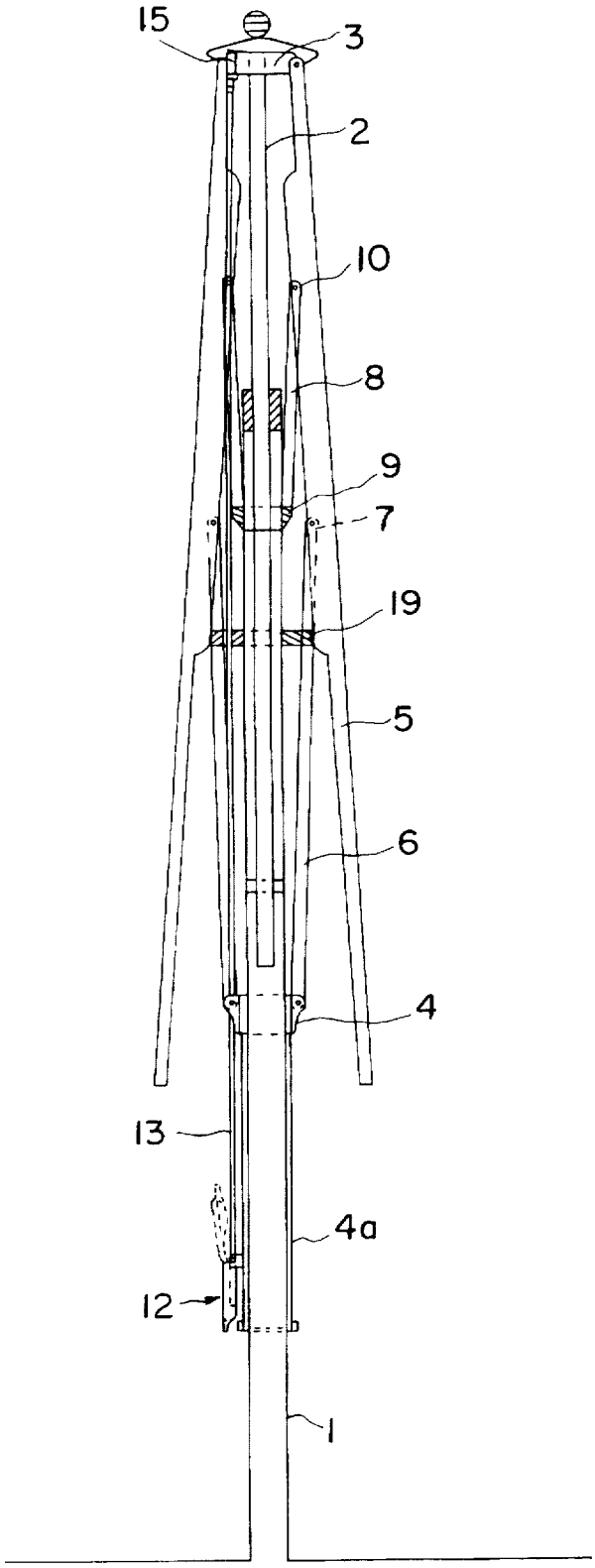
FIG. 2 The umbrella as per FIG. 1 in closed position.
Figure 4:
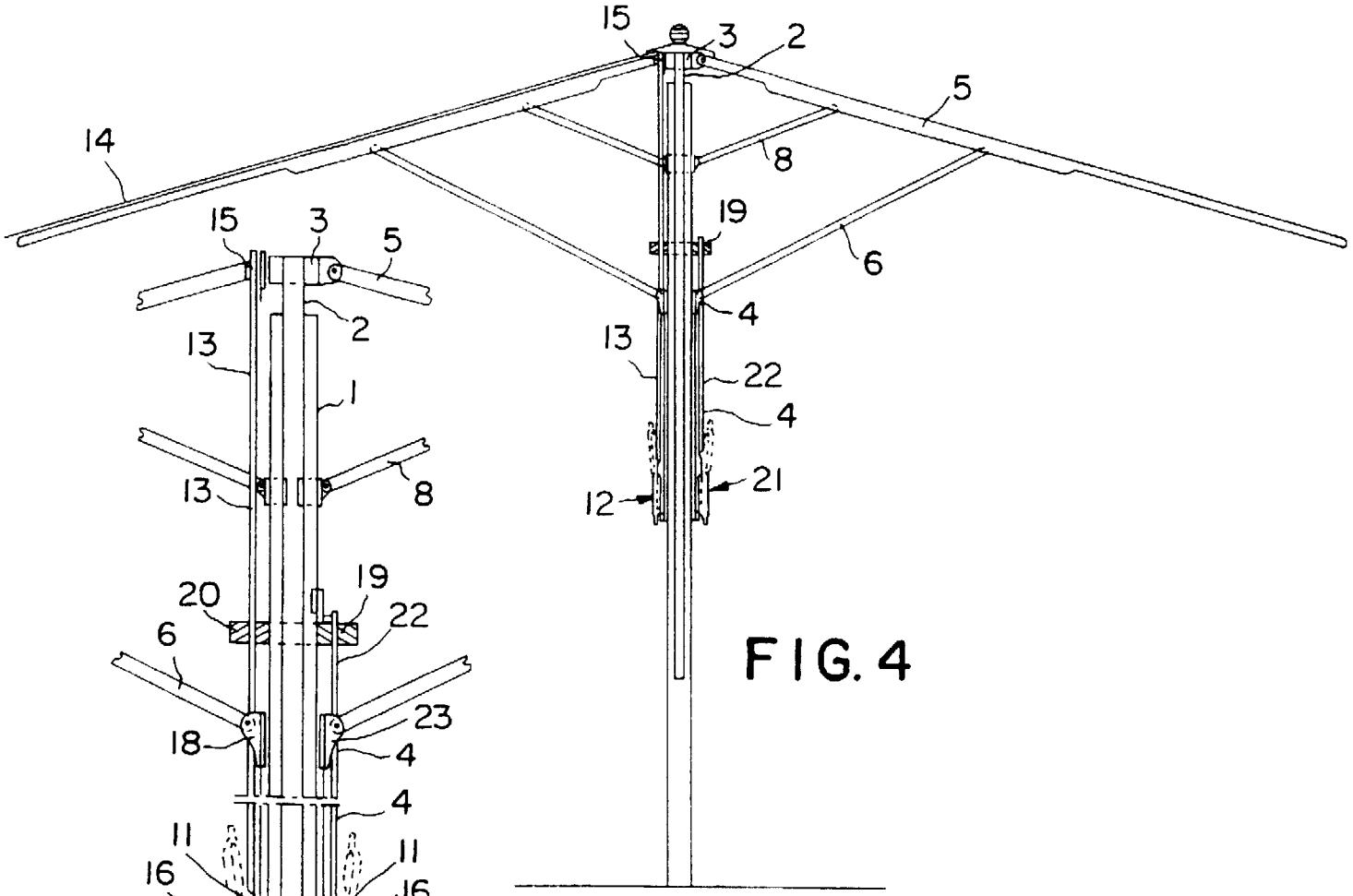
FIG. 4 A second umbrella in open position.

The umbrella illustrated in FIGS. 1 and 4 has a vertical pipe 1, in which pole element 2 is mounted in a telescopically moveable manner. Pole element 2 is fitted with a cap 3, to which roof rods 5 are linked. Slide 4 is moveable along the rigid vertical pipe 1. Between slide 4 and roof rods 5 are stretchers with links on both sides. The linkage points on the roof rods are indicated by 7.

Furthermore, additional stretchers 8 are also provided, either distributed evenly right around the umbrella, or at least two fitted opposite each other. Additional stretchers 8 are linked, on the one hand, to umbrella pipe 1 at 9, and, on the other hand, to roof rods 5 at 10.

Slide 4 is provided with a tubular extension 4*a*, running towards the lower end of the umbrella pipe, which serves to facilitate handling when moving slide 4. A tension lever lock 12 is attached to tubular extension 4*a*. This works in conjunction with an abutment 11 which is located at the lower end of a rigid retaining arm 13 which is fixed to cap 3 at 15. The canopy or umbrella cover is indicated by 14.

Cap 3 and slide 4 automatically move towards and away from each other during closing and opening of the umbrella. The automatic opposite motion of cap 3 and slide 4 is produced as a result of the frame design and its diametrically arranged additional stretchers 8, which are rigidly linked to vertical pipe 1 at 9 and act on the roof rods at 10. During closing, slide 4 is pulled downwards by tube extension 4*a*, whereupon additional stretchers 8 move stretchers 6 in the direction of the umbrella pipe. Pole element 2 is thus pushed upwards with cap 3, which results in the roof rods being set against vertical pipe 1. When the umbrella is closed, slide 4, with tubular extension 4*a* serving as the handle, is initially pushed upwards with very little expenditure of energy until the umbrella is almost fully opened. As soon as an initial change in hand resistance becomes apparent while slide 4, 4*a* is being pushed up (start of the actual roof stretching phase), reversible tension spring clip 16 of tension lever lock 12 can be latched into abutment 11 by means of tension lever 17. The tendency of slide 4, 4*a* to move back down after release of its downward-pointing extension 4*a*, which serves as a handle, is thus initially prevented. Hand lever 17 of tension lever lock 12 is then moved downwards, overcoming a working point. This can be done by hand, e.g. with the ball of the hand. The process of moving tension lever 17 produces the force necessary to negotiate the remaining travel path of slide 4 and overcome the associated mechanical resistance which builds up during stretching of the canopy.

The length of retaining arm 13 should be selected in such a manner that, during manual raising of slide 4, 4*a*, tension spring clip 16 of tension lever lock 12 at least approximately reaches the spatial position in which tension spring clip 16 can be latched into abutment 11 at the lower end of retaining arm 13 without difficulty, before further raising of the slide causes a greater mechanical resistance than that during the simple raising process of slide 4, 4*a*.

Slide 4 has a drilled hole 18 or an open elongated slot, through which holding arm 13 is passed, meaning that the latter can slide with practically no friction in comparison with the movement of slide 4.

Figure 10:
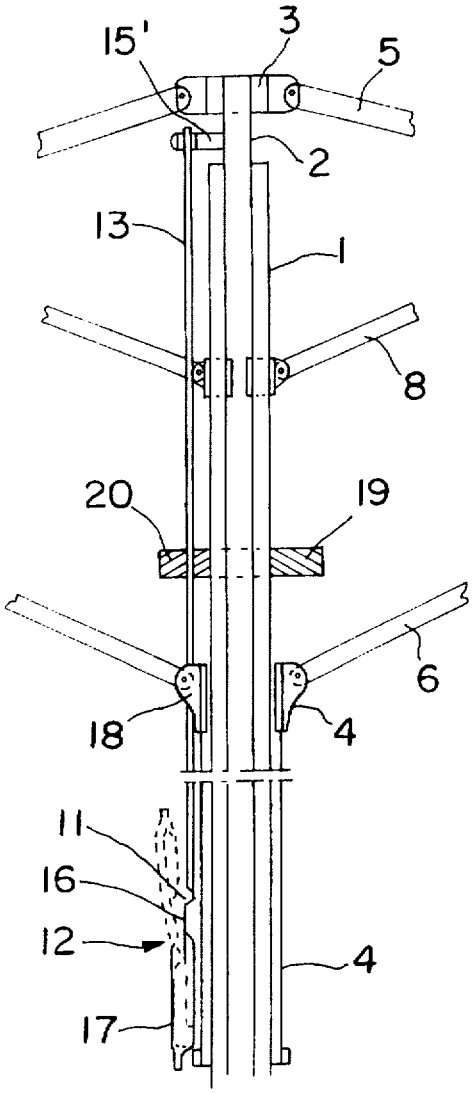
FIG. 10 A large-scale, schematic view of details of another umbrella pipe and locking device.

Instead of the described configuration, it is also possible to fix the retaining arm 13 for the abutment on moveable pole element 2 above vertical pipe 1, as shown in FIG. 10 by fixing point 15', or even within vertical pipe 1. In the latter case, the moveability of pole element 2 or slide 4 is guaranteed by the fact that the outer wall of pole element 2 or slide 4, 4*a* has a vertical elongated hole recess of appropriate length, through which the retaining arm for abutment 11 reaches. In this context, abutment 11 can also be combined with the retaining arm to yield a component constituting the abutment.

In the practical example shown in the drawings, a second guide element 19 with a drilled hole 20 or an open elongated slot, in which retaining arm 13 can slide with practically no friction and which is located on vertical pipe 1 above slide 4, 4*a*, is envisaged to guide retaining arm 13.

Figure 6:
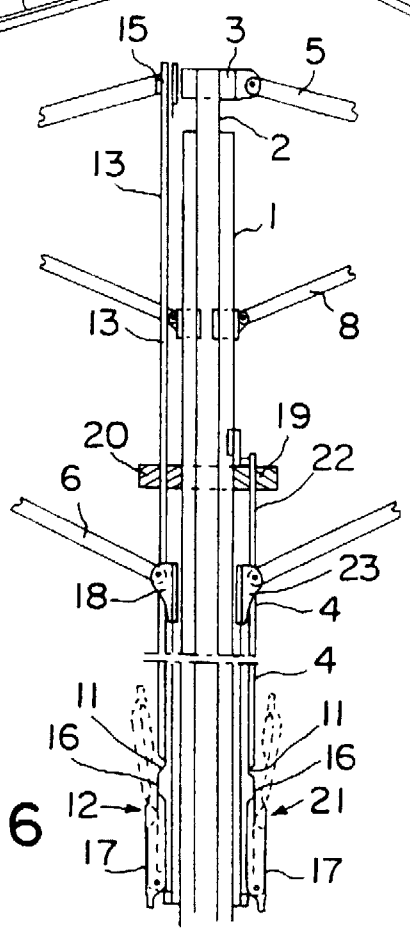
FIG. 6 A large-scale, schematic view of details of the umbrella as per FIG. 4.
Figure 5:
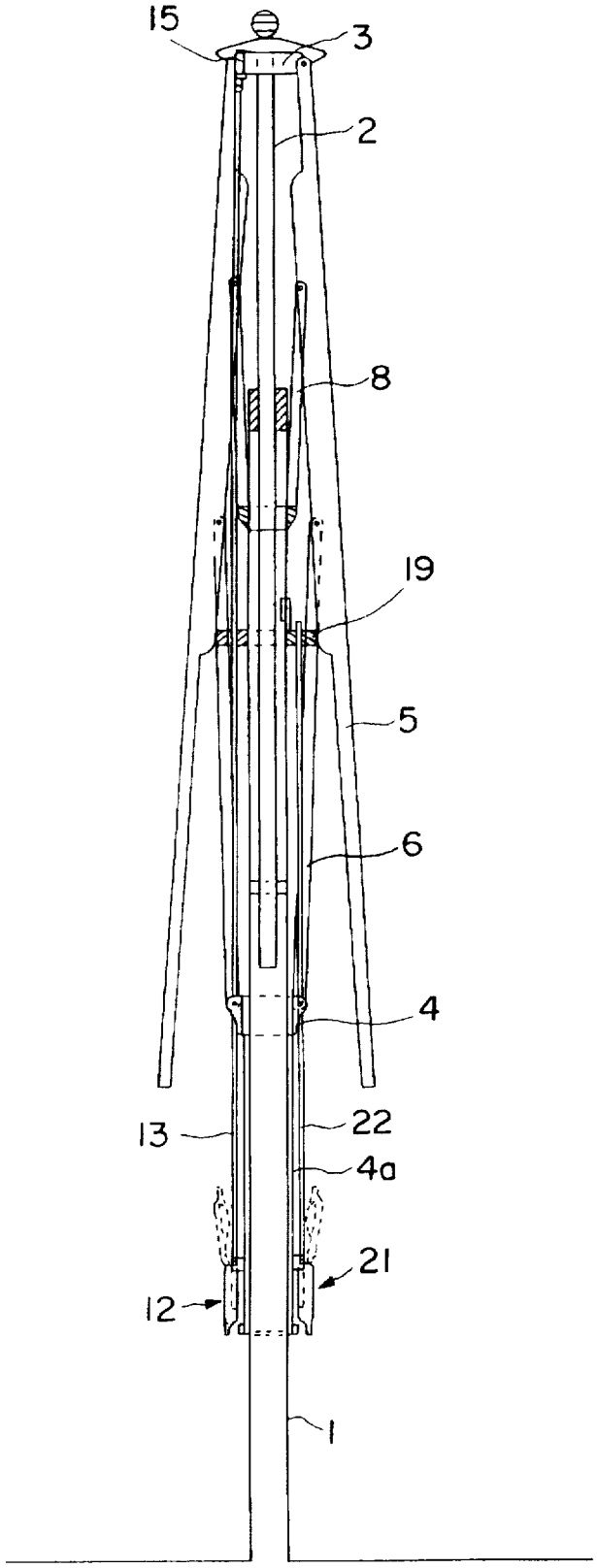
FIG. 5 The umbrella as per FIG. 4 in closed position.

The second practical example, shown in FIGS. 4 to 6, relates to a larger umbrella, with a diameter of 5 m for example, which has a second locking device 21 of the kind known from DE-A-41 06 147. This is located on slide 4, 4*a* at a point diametrically opposite to the first locking device 12. Like the first device, it is also designed as a tension lever lock which works in conjunction with an abutment 11. Abutment 11 is situated at the lower end of a second rigid retaining arm 22, which is fixed to vertical pipe 1, e.g. on guide element 19, above the travel path of slide 4.

To open this umbrella, slide 4, with tubular extension 4*a* serving as the handle, is again initially pushed upwards with little expenditure of energy until the umbrella is largely opened. As soon as the initial change in hand resistance becomes apparent during this process (start of the roof stretching phase), reversible tension spring clip 16 of the second locking device 21 can be latched into abutment 11 by means of hand lever 17. After this, hand lever 17 of the second locking device 21 can be moved downwards, overcoming a working point, thus achieving considerable pre-tensioning of the canopy, even at this first opening stage, and tension spring clip 16 of locking device 12, fitted opposite slide 4, 4*a*, can be latched into abutment 11 by means of hand lever 17. The hand lever of locking device 12 can be moved downwards manually, overcoming a working point, which results in cap 3 being pulled downwards via the rigid retaining arm 13. Although the path along which cap 3 moves is only a few centimeters, it results in further curving of the canopy, which causes an increase in the overall roof tension, owing to the position of stretchers 6 and additional stretchers 8 being locally fixed by the first opening stage. This second opening stage ultimately achieves a static roof tension potential which has hitherto not been possible, either directly or indirectly, with any other umbrella construction, especially those without drive units.

Slide 4 has a drilled hole 23 or an open elongated slot to guide the second retaining arm 22, which permits retaining arm 22 to slide freely in comparison with the movement of slide 4.

In order to achieve as low a centre of gravity of the overall umbrella as possible in relation to the floor level, and thus a particularly high degree of tilt resistance and column buckling resistance, the friction and weight ratios of the moveable umbrella components are counterbalanced by suitable dimensioning of the length of moveable pole element 2 and insertion of counterweight 24 into the lower, open end of pole element 2, as shown in three examples in FIG. 7, in such a way that slide 4 at least virtually comes to a halt if released while opening the umbrella. The lengthening of pole element 2 for umbrellas with large diameters is accompanied by an increase in umbrella height. It is only limited by the lower end of pole element 2 pushing against an envisaged internal reinforcement in the lower region of vertical pipe 1 (not shown in the drawings) when the umbrella is open.

As shown in FIG. 8, counterweight 24 can be pushed into the lower, open end of moveable pole element 2, the lower end then being sealed by a plastic slide 25. The annular plastic slide 25 projects radially at the lower end of pole element 2 and its outer wall contacts the inner profile of vertical pipe 1. Extension 26 of plastic slide 25 reaches into the lower end of pole element 2 and is fixed to pole element 2 there by means of radial screws 27.

Counterweight 24 is located above extension 26 and has a radial through-hole in alignment with two opposite openings 28 in pole element 2.

As shown in the cross-section in FIG. 9, counterweight 24 is fixed by a dowel pin 30 which extends through openings 28 and through-hole 29.

Although a preferred embodiment of the invention has been specifically illustrated and described herein, it is to be understood that minor variations may be made in the apparatus without departing from the spirit and scope of the invention, as defined the appended claims.

I claim:

1. An umbrella comprising a canopy (14) supported by a plurality of roof rods (5), a pole element (2) in telescopic sliding relationship to a vertical pipe (1), said roof rods (5) being linked to said pole element (2), said pole element (2) carrying a cap (3), a slide (4) slidable relative to said vertical pipe (1), a plurality of stretchers (6) linked to said slide (4) and to said roof rods (5), at least one additional stretcher (8) linked to said roof rods (5) and to said-vertical pipe (1), said slide (4) carrying a locking device (12) which is locked in an open position of said canopy (14), a retaining device (13) carried by the cap (3) of said pole element (2), and said locking device (12) locks relative to said retaining device (13) in said open position.

2. The umbrella as defined in claim 1 wherein said retaining device (13) is a retaining arm (13) fixed to the cap (3) of said pole element (2).

3. The umbrella as defined in claim 1 wherein said locking device (12) is a tension lever lock; and said tension lever lock includes an abutment (11) located on said retaining device (13) and a tension element (16, 17) which interlocks with said abutment (11).

4. The umbrella as defined in claim 1 wherein said locking device (12) is a tension lever lock; said tension lever lock includes an abutment (11) located on said retaining device (13) and a tension element (16, 17) which interlocks with said abutment (11), and said slide (4) includes a tubular extension (4*a*) carrying said tension element (16, 17).

5. The umbrella as defined in claim 1 wherein said slide (4) includes an opening (18) through which passes said retaining device (13).

6. The umbrella as defined in claim 1 including a second locking device (21) which works in conjunction with a second retaining device (22) located on the vertical pipe (1).

7. The umbrella as defined in claim 4 wherein said retaining device (13) is a retaining arm (13) fixed to the cap (3) of said pole element (2).

8. The umbrella as defined in claim 4 wherein said slide (4) includes an opening (18) through which passes said retaining device (13).

9. The umbrella as defined in claim 7 wherein said slide (4) includes an opening (18) through which passes said retaining device (13).

10. An umbrella comprising a canopy (14) supported by a plurality of roof rods (5), a pole element (2) in telescopic sliding relationship to a vertical pipe (1), said roof rods (5) being linked to said pole element (2), a slide (4) slidable relative to said vertical pipe (1), a plurality of stretchers (6) linked to said slide (4) and to said roof rods (5), at least one additional stretcher (8) linked to said roof rods (5) and to said vertical pipe (1), said slide (4) carrying a locking device (12) which is locked in an open position of said canopy (14), a retaining device (13) carried by said pole element (2), and said locking device (12) locks relative to said retaining device (13) in said open position.

11. The umbrella as defined in claim 10 wherein said retaining device (13) is a retaining arm (13) fixed to the pole element (2).

12. The umbrella as defined in claim 10 wherein said locking device (12) is a tension lever lock; and said tension lever lock includes an abutment (11) located on said retaining device (13) and a tension element (16, 17) which interlocks with said abutment (11).

13. The umbrella as defined in claim 10 wherein said locking device (12) is a tension lever lock; said tension lever lock includes an abutment (11) located on said retaining device (13) and a tension element (16, 17) which interlocks with said abutment (11), and said slide (4) includes a tubular extension (4*a*) carrying said tension element (16, 17).

14. The umbrella as defined in claim 10 wherein said slide (4) includes an opening (18) through which passes said retaining device (13).

15. The umbrella as defined in claim 10 including a second locking device (21) which works in conjunction with a second retaining device (22) located on the vertical pipe (1).

16. The umbrella as defined in claim 13 wherein said retaining device (13) is a retaining arm (13) fixed to the cap (3) of said pole element (2).

17. The umbrella as defined in claim 13 wherein said slide (4) includes an opening (18) through which passes said retaining device (13).

18. The umbrella as defined in claim 16 wherein said slide (4) includes an opening (18) through which passes said retaining device (13).

* * * * *